US008072296B2

(12) United States Patent
Grassano et al.

(10) Patent No.: US 8,072,296 B2
(45) Date of Patent: Dec. 6, 2011

(54) DELAY ELEMENT WITH A PERTURBER DISPLACEABLE BETWEEN FIRST AND SECOND MICROSTRIP CIRCUITS

(75) Inventors: Giuseppe Grassano, Milan (IT); Vincenzo Boffa, Milan (IT); Fabrizio Gatti, Milan (IT); Luca Risi, Milan (IT); Alfredo Ruscitto, Turin (IT); Paolo Semenzato, Rome (IT)

(73) Assignee: Pirelli & C. S.p.A., Milan (IT)

( * ) Notice: Subject to any disclaimer, the term of this patent is extended or adjusted under 35 U.S.C. 154(b) by 117 days.

(21) Appl. No.: 12/312,845

(22) PCT Filed: Nov. 30, 2006

(86) PCT No.: PCT/EP2006/011498

§ 371 (c)(1),
(2), (4) Date: May 29, 2009

(87) PCT Pub. No.: WO2008/064705

PCT Pub. Date: Jun. 5, 2008

(65) Prior Publication Data

US 2010/0066464 A1 Mar. 18, 2010

(51) Int. Cl.
*H01P 1/18* (2006.01)

(52) U.S. Cl. ..... 333/161

(58) Field of Classification Search ..... 333/161, 333/156

See application file for complete search history.

(56) References Cited

U.S. PATENT DOCUMENTS 2,669,694 A 2/1954 Vogeley, Jr. et al.
2,774,946 A 12/1956 McGillem et al.
2,775,741 A 12/1956 Corbell
2,779,003 A 1/1957 Allen et al.
2,951,218 A 8/1960 Arditi (Continued)

FOREIGN PATENT DOCUMENTS

GB 591369 8/1947

(Continued)

OTHER PUBLICATIONS

International Search Report dated Jan. 4, 2007, submitted in corresponding U.S. Appl. No. 12/227,833 3 pages.

(Continued)

*Primary Examiner* — Benny Lee
(74) *Attorney, Agent, or Firm* — Finnegan, Henderson, Farabow, Garrett & Dunner, L.L.P.

(57) ABSTRACT

A differential delay element for use, e.g., in selectively delaying RF signals in telecommunication systems includes a first microstrip circuit and a second microstrip circuit arranged side-by-side in a facing relationship. The first microstrip circuit defines a first delayed travel path for a first signal from a first input port to a first output port and the second microstrip circuit defines a second delayed travel path for a second signal from a second input port to a second output port. A perturber is arranged between the first and second microstrip circuits, displaceable toward and away from the first and second microstrip circuits, so that when the distance of the perturber to one of the microstrip circuits increases, the distance of the perturber to the other of the microstrip circuits decreases and viceversa. The position of the perturber between the first and second microstrip circuits defines the differential delay, namely the difference ($\Delta\tau=\tau1-\tau2$) between the times ($\tau1,\tau2$) experienced by the two signals in travelling their travel paths through the delay device.

15 Claims, 3 Drawing Sheets

U.S. PATENT DOCUMENTS

| | | | | |
|---|---|---|---|---|
| 3,456,355 | A | 7/1969 | Cumming et al. | |
| 3,555,232 | A | 1/1971 | Bleackley | |
| 4,613,836 | A | 9/1986 | Evans | |
| 4,788,515 | A | 11/1988 | Wong et al. | |
| 4,973,925 | A | 11/1990 | Nusair et al. | |
| 4,992,762 | A | 2/1991 | Godshalk et al. | |
| 5,949,303 | A * | 9/1999 | Arvidsson et al. | 333/136 |
| 6,075,424 | A | 6/2000 | Hampel et al. | |
| 6,441,700 | B2 * | 8/2002 | Xu | 333/161 |
| 6,504,450 | B2 | 1/2003 | Kim et al. | |
| 6,816,668 | B2 * | 11/2004 | McDonald et al. | 392/375 |
| 7,283,015 | B1 * | 10/2007 | Rockenbauch | 333/33 |
| 2002/0057136 | A1 | 5/2002 | Marketkar et al. | |
| 2003/0042997 | A1 | 3/2003 | Baik et al. | |
| 2004/0075967 | A1 | 4/2004 | Lynch et al. | |
| 2005/0052821 | A1 | 3/2005 | Fujii et al. | |

FOREIGN PATENT DOCUMENTS

| | | |
|---|---|---|
| JP | 2001-68901 | 3/2001 |
| WO | WO 89/07837 | 8/1989 |
| WO | WO 2004/086730 A2 | 10/2004 |
| WO | WO 2006/037364 A1 | 4/2006 |

OTHER PUBLICATIONS

Yun et al.; "A Low-Loss Time-Delay Phase Shifter Controlled by Piezoelectric Transducer to Perturb Microstrip Line", IEEE Microwave and Guided Wave Letters, vol. 10, No. 3, pp. 96-98, (2000).

Yun et al.; "Time-Delay Phase Shifter Controlled by Piezoelectric Transducer on Coplanar Waveguide", IEEE Microwave and Wireless Components Letters, vol. 13, No. 1, pp. 19-20, (2003).

Yun et al.; "Analysis and Optimization of a Phase Shifter Controlled by Piezoelectric Transducer", IEEE Transactions on Microwave Theory and Techniques, vol. 50, No. 1, pp. 105-111, (2002).

W.T. Joines; "A Continuously Variable Dielectric Phase Shifter", IEEE Transactions on Microwave Theory and Technique, pp. 729-732 (1971).

* cited by examiner

DELAY ELEMENT WITH A PERTURBER DISPLACEABLE BETWEEN FIRST AND SECOND MICROSTRIP CIRCUITS

CROSS REFERENCE TO RELATED APPLICATION

This application is a national phase application based on PCT/EP2006/011498, filed Nov. 30, 2006, the content of which is incorporated herein by reference.

FIELD OF THE INVENTION

The invention relates to delay elements for use e.g. in telecommunication systems.

DESCRIPTION OF THE RELATED ART

Conventional technologies for producing delay elements for use in signal processing e.g. in telecommunication systems include, among other technologies, dielectrically perturbed microstrip delay lines. Perturbation of an electromagnetic field obtained by moving a dielectric or metallic "perturber" is thus the basic principle underlying operation of a variety of delay devices discussed in the technical literature.

For instance, Tae-Yeoul Yun and Kai Chang: "A Low-loss Time-Delay Phase Shifter Controlled by Piezoelectric Transducer to Perturb Microstrip Line", IEEE MICROWAVE AND GUIDED WAVE LETTERS, VOL. 10, NO, 3, MARCH 2000, pages 96-98, describes a time-delay phase shifter operating in a ultra-wide bandwidth ranging from 10 GHz up to 40 GHz. The phase shifter described in that article is controlled by a piezoelectric transducer, which moves a dielectric perturber above a microstrip line. Reportedly, a maximum phase shift of 460° with respect to the unperturbed condition is achieved with an increased insertion loss of less than 2 dB and a total loss of less than 4 dB up to 40 GHz.

A substantially similar arrangement is described in Tae-Yeoul Yun, and Kai Chang: "Analysis and Optimization of a Phase Shifter Controlled by Piezoelectric Transducer", IEEE TRANSACTIONS ON MICROWAVE THEORY AND TECHNIQUES, VOL. 50, NO. 1, JANUARY 2002, pages 105-111 Specifically, this document discloses a method for analyzing and optimizing a time-delay phase shifter controlled by a piezoelectric transducer.

Another development of the same basic arrangement is described in Sang-Gyu Kim, Tae-Yeoul Yun, and Kai Chang: "Time-Delay Phase Shifter Controlled by Piezoelectric Transducer on Coplanar Waveguide", IEEE MICROWAVE AND WIRELESS COMPONENTS LETTERS, VOL. 13, NO. 1, JANUARY 2003, pages 19-20. Specifically, this document describes a time-delay phase shifter controlled by a piezoelectric transducer realized on a coplanar waveguide. The effective dielectric constant, propagation constant, etc., of the coplanar waveguide are varied by the movement of the perturber, which causes a variation of the phase-shift introduced by the line.

W. T. Joines: "A Continuously Variable Dielectric Phase Shifter", WILLIAM T. JOINES, IEEE TRANSACTIONS ON MICROWAVE THEORY AND TECHNIQUES, AUGUST 1971, pages 729-732 describes a stripline phase shifter which produces a linear variable phase shift versus frequency by varying the dielectric constant of a medium through which the signal propagates. The phase shifter in question is comprised of a semicircular stripline placed between two parallel circular plates each one made of two different dielectric materials. The two plates rotate solidly around the center of the stripline upon sliding contact and yield a variation of the dielectric constant of material surrounding the stripline.

Document WO-A-2004/086730 describes arrangements that involve the use of an inhomogeneous dielectric constant rotating disk. This document discloses a rotary differential phase modulator in phase sweeping apparatus for transmitting diversity in cellular base station used in telecommunication systems. The phase modulator consists of multiple microstrips periodically loaded by rotating a dielectric semi-disk. A rotation speed of the disk can be of the order of 3000 to 6000 RPM. The required wave-shape of the phase sweep is realized by appropriate shaping of the disk and line pattern.

A somewhat similar arrangement is described e.g. in U.S. Pat. No. 6,504,450, which discloses apparatus capable of shifting phases of N input signals and including a dielectric member, a certain number of transmission lines positioned opposite to the member, as well as means for rotating the dielectric member to an axis perpendicular to the plane of transmission lines. The dielectric member is made of two portions with different dielectric constants. When each of the signals is passing through the corresponding transmission line, it has a phase shifted by rotating the dielectric member.

Alternative solutions for producing variable delay elements (typically used in the radio-frequency and microwave region) include time variable delay lines based on various technologies.

These include e.g. electromechanical-switch delay lines where delay lines having different lengths are connected/isolated by means of electromechanical switches. In this case, a device is obtained whose resolution corresponds to the number of switches.

Other known arrangements include diode switch delay lines, i.e. delay lines having different lengths connected/isolated by means of electronic switches based on semiconducting diodes and varactor phase-shifters/delay lines; in this latter case a transmission line is loaded by variable capacitance components, named varactors.

Another type of known arrangements are rotary-field ferrite devices, which are effective for high power, low loss applications in the range of 10 GHz.

OBJECT AND SUMMARY OF THE INVENTION

The Applicants have observed a number of disadvantages that inevitably militate against the possibility of adopting in a fully satisfactory manner any of the prior art arrangements discussed in the foregoing.

For instance, several of the arrangements considered in the foregoing fail to provide satisfactory results in terms of return loss, power losses, phase-shift, delay, and power handling capability. More to the point, the characteristics in terms of delay vs. driving signal is approximately exponential (i.e. generates marked high frequency components in the movement of the actuator), and thus far from being linear or nearly linear as desirable in most applications.

Additionally, most of the prior art arrangements discussed in the foregoing use a piezoelectric actuator (i.e., a "bender") to move the perturber While useful for static operation, such an actuator is not sufficiently reliable for continuous operation and, in general, in those operating scenarios where mechanical stress to the actuator is a limiting parameter for electromechanical devices. Mechanical stress, which strongly limits the useful lifetime and reliability of the actuator, arises whenever moving parts are subjected to strong accelerations. Mechanical stress also depends on the mass (weight) of moving part(s) such as the perturber. In particular, mechanical stress increases when any of the frequency of operation, the mass of the moving part(s), and/or the perturber excursion is increased and/or when speed is abruptly changed during excursion While frequency is determined by the specific application envisaged, device design should maximize inserted time delay, while at the same time reducing excursion and dimensions and weight of moving parts, and avoiding high frequency components in the frequency spectrum of temporal excursion.

In those arrangements that use a rotary disk as the perturber, an arbitrary temporal delay function $\Delta_{diff}(t)$ is intrinsically difficult to obtain: this in fact requires changing the rotational speed of the perturber disk, thus imposing very strong stresses on the motor of the disk. In any case, the presence of the motor penalizes the arrangement in terms of size, especially when microstrips are placed on the same substrate.

The main drawback of technologies that use mechanical switches is low reliability (limited to few millions of switch events) and low speed; both aspects limit the use of switches in continuous and fast applications. Semiconducting diodes used as switches exhibit high reliability and switching speed, but are lossy and support only limited RF power, which limits their field of application to low power variable delay. Varactors similarly present high RF losses and low power handling; additionally, they are not linear components. Rotary-field ferrite devices are based on ferrite materials which are extremely lossy in the range of a few GHz, thus making it largely unpractical to use ferrite-based devices in that frequency range.

The Applicant has thus tackled the problem of providing an improved arrangement that dispenses with at least some of the drawbacks outlined in the foregoing, that is a delay element which preferably:

- provides satisfactory results in terms of return loss, power losses, delay, and power handling capability, i.e. does not exhibit high RF losses and is able to support high levels of RF power, even at a few GHz and below;
- is thoroughly reliable for fast, continuous operation, with practically no limitations in terms of switching events;
- does not rely on complex, sensitive and/or bulky arrangements such as rotary disks with the associated driving motor; and
- exhibits substantially linear characteristics in terms of delay vs. perturber displacement/driving signal.

The applicant has found that this problem can be solved by means of a delay element. The invention also relates to a corresponding method.

In brief, a preferred embodiment of the arrangement described herein is a delay element comprising:

- a first microstrip circuit and a second microstrip circuit, wherein the first microstrip circuit defines a first delayed travel path for a first signal from a first input port to a first output port and the second microstrip circuit defines a second delayed travel path for a second signal from a second input port to a second output port, the first and second microstrip circuits being arranged side-by-side in a facing relationship; and
- a perturbing member arranged between the first and second microstrip circuits, displaceable towards and away from the microstrip circuits, whereby when the distance of the perturber to one of the microstrip circuits increases, the distance of the perturber to the other decreases and viceversa; the position of the perturber between the first and second microstrip circuits defining the difference between the time experienced by the first signal in travelling said the delayed travel path and the time experienced by the second signal in travelling the second delayed travel path. Typically, an actuator is provided to move the perturber between the first and second microstrip circuits.

The position of the perturber between the first and second microstrip circuits may define the difference ($\Delta\tau=\tau1-\tau2$) between the time ($\tau1$) experienced by the first signal in travelling the first delayed travel path and the time ($\tau2$) experienced by the second signal travelling the second delayed travel path.

The delay element may include an actuator to move the perturber between the first and second microstrip circuits;

wherein the actuator may be configured for displacing the perturber symmetrically with respect to a mean point between the first and second microstrip circuits;

wherein the actuator may be configured for displacing the perturber over a maximum excursion lower than 2 mm;

wherein the actuator may be configured for displacing the perturber over a maximum excursion lower than 1 mm;

wherein the actuator may be configured for displacing the perturber over an excursion of approximately 0.25 mm;

wherein the minimum distance between the perturber element and any of the first and second microstrip circuits may be greater than 0.05 mm;

wherein the first and second microstrip circuits may be arranged parallel to each other;

wherein the perturber may have opposite planar surfaces facing and arranged parallel to the first and second microstrip circuits;

wherein the first and second microstrip circuits may include a dielectric substrate (12*a*, 14*a*) having a metallic microstrip (12*b*, 14*b*) provided thereon, wherein the metallic microstrips may be arranged facing each other with the interposition of the perturber;

wherein the first and second microstrip circuits may include a dielectric substrate having respective dielectric constants $\in_{r1}$, $\in_{r2}$ and the perturber may include a dielectric material having a perturber dielectric constant $\in_{pert}$, and wherein $\in_{pert}>>\in_{r1}, \in_{r2}$; and wherein the perturber may include a metallic material.

The present invention includes a method of delaying electrical signals including the steps of:

- defining a first delayed travel path for a first signal from a first input port to a first output port in a first microstrip circuit as well as a second delayed travel path for a second signal from a second input port to a second output port in a second microstrip circuit,
- arranging the first and second microstrip circuits side-by-side in a facing relationship with a perturber element arranged between the first and second microstrip circuits, and
- displacing the perturber towards and away from the first and second microstrip circuits, whereby when the distance of the perturber to one of the first and second microstrip circuits increases, the distance of the perturber to the other of the first and second microstrip circuits decreases and viceversa; the position of the perturber between the first and second microstrip circuits defining the difference ($\Delta\tau=\tau1-\tau2$) between the time ($\tau1$) experienced by the first signal in travelling the first delayed travel path and the time ($\tau2$) experienced by the second signal in travelling the second delayed travel path, In accordance with the present invention, there is also provided a telecommunication apparatus for transmitting first and second signals via corresponding diversity antennas, the apparatus comprising a delay element described above, wherein the first and second signals pass through respectively the first and second delayed travel paths of the delay element.

By providing a second microstrip circuit such an arrangement becomes a tunable, differential delay line, in which the perturber is brought alternatively closer to one microstrip and farther from the other microstrip circuits. As a result, the perturber alternatively accelerates the electromagnetic signals in one microstrip circuit and, at the same time, slows down the electromagnetic signals in the other microstrip circuit, thus enhancing the perturbation effect with respect to single-substrate configuration. In comparison with a single-substrate configuration, the arrangement described herein leads to reduced complexity in the microstrip design and a lower displacement being required for the perturber. This in turn renders less demanding the requirements on linear actuators, which have heretofore represented a major technical limitation in the practical implementation of this kind of device. Moreover, by judiciously selecting the geometric and electromagnetic parameters, the delay element described herein can operate in a linear (or quasi-linear) region of its delay vs. perturber displacement characteristics of the perturber, enabling a simplified control of the device.

Preferably, the device includes microstrips able to support high RF power signals (e.g. of the order of many tens of Watts or more), as well as low power electromagnetic signals, while introducing very limited insertion losses, in the range of about 1 dB or less. Microstrips can be e.g. metallic microstrips or dielectric waveguides. The device can be used in telecommunication systems, typically in transmission paths, involving very high RF power levels to be managed.

The arrangement described herein has a number of advantages.

For instance, the arrangement described herein generates a (differential) delay which is more than twice the delay generated in conventional solutions under the same mechanical stress conditions (that is, using a perturber of equal size and mass subject to the same excursion); additionally, the delay characteristic of the arrangement described herein is nearly linear, in comparison to approximately exponential—i.e. not linear at all—for conventional solutions; finally, if one considers the perturber displacement needed for obtaining the same temporal delay function, the frequency spectrum of the curve displacement vs. time for the arrangement described herein contains less pronounced high frequency components in comparison to conventional solutions.

BRIEF DESCRIPTION OF THE DRAWINGS

The invention will now be described, by way of example only, with reference to the drawings, wherein.

The invention will now be described, by way of example only, with reference to the annexed representations, wherein.

DETAILED DESCRIPTION OF PREFERRED EMBODIMENTS

Figure 1:
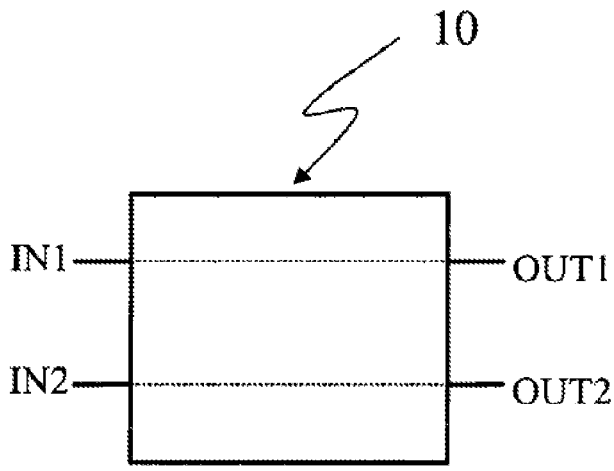
FIG. 1 is a schematic overall representation of a delay element as described herein.

In FIG. 1, reference 10 denotes as a whole a delay element suitable for operating on electromagnetic signals e.g. in the radio-frequency (RF) and microwave (MW) ranges.

The element 10 of FIG. 1 is a differential tunable delay line (DTDL), that is a four-port device having two input ports (IN1 and IN2) and two output ports (OUT1 and OUT2). The input port IN1 is connected to the output port OUT1 and the input port IN2 is connected to the input port OUT2.

Figure 2:
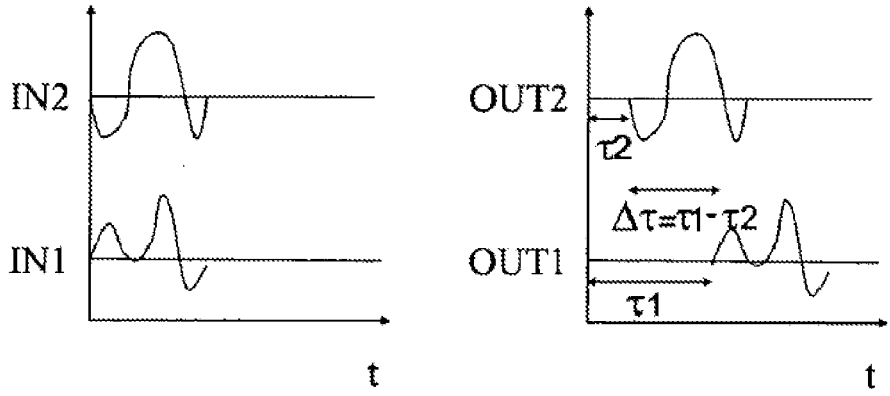
FIG. 2 is a set of diagram representative of operation of the delay element of FIG. 1.

In operation, two input electromagnetic signals (e.g. P1 and P2 in FIG. 7) feed the two input ports IN1, IN2 of the device 10 of FIG. 1 and exit from the two output ports OUT1, OUT2. As shown in FIG. 2, the element/device 10 applies a first, time-variable time delay $\tau 1$ to the electromagnetic signal input through IN1 and output from OUT1 and a second, time-variable time delay $\tau 2$ to the electromagnetic signal that input through IN2 and output from OUT2.

As a result of passing through the delay device 10, the electromagnetic signals output from OUT1 and OUT2 exhibit a differential time delay $\Delta\tau=\tau 1-\tau 2$ with respect to the electromagnetic signals input into IN1 and IN2, as shown in FIG. 2. The differential time delay et introduced by the delay device 10 can be either kept fixed or temporally varied and controlled, as better described in the following.

Figure 3:
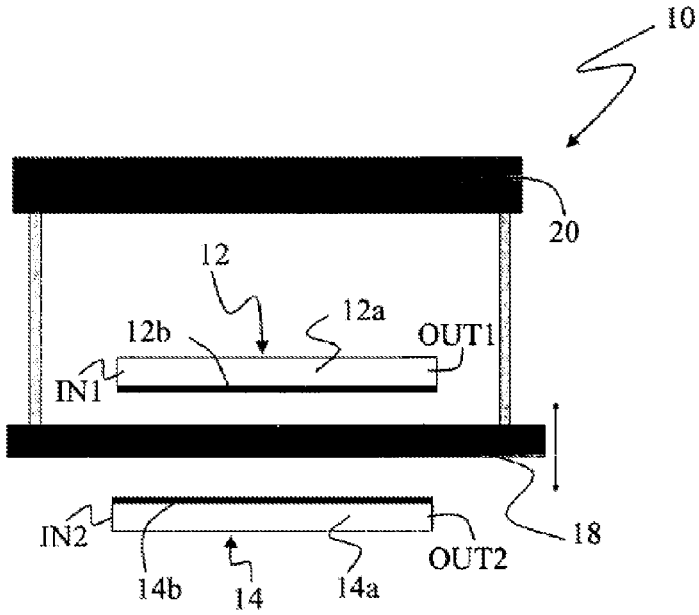
FIG. 3 is a schematic representation of one embodiment of the delay element as described herein.

The device 10 has the structure illustrated in FIG. 3 and includes two microstrip circuits 12, 14, such as e.g. metallic microstrips, realized on two dielectric substrates 12*a*, 14*a*.

The first microstrip circuit 12 has input and output ports corresponding to IN1 and OUT1; the second microstrip circuit 14 has input and output ports corresponding to IN2 and OUT2. The two substrates 12*a*, 14*a* are arranged side-by side, parallel to each other, at a distance of a few millimetres or less, with the two microstrips 12*b*, 14*b* facing each other and defining therebetween a spatial region separating the two substrates 12*a*, 14*a*.

A perturber 18 in the form of a plate or bar of dielectric materials, metallic materials, or different layers of dielectric and metallic materials, is arranged in the spatial region between the two substrates. The perturber is thus "sandwiched" between the two microstrip circuits 12, 14 in such a way that the opposite planar surfaces of the perturber 18 are parallel to the surfaces of the substrates 12*a*, 14*a*, facing the strips 12*b*, 14*b* provided thereon.

A linear actuator 20 supports the perturber 18 (e.g. at opposite ends of the perturber plate/bar) with the capability of displacing the perturber 18 in the direction of the double arrow at the right of FIG. 3, i.e. along the direction perpendicular to the planar surfaces of the perturber. Actuator 20 can be e.g. a voice coil actuator.

The movement thus produced is essentially in the form of controlled alternative displacement with respect to a central position midway the microstrip circuits 12, 14. Consequently, when the distance between the perturber 18 and the first microstrip 12 decreases (upward movement of the perturber 18 in FIGS. 3 and 4) the distance between the perturber 18 and the second microstrip 14 increases of the same amount. Conversely, when the distance between the perturber 18 and the first microstrip 12 increases (downward movement of the perturber 18 in FIGS. 3 and 4) the distance between the perturber 18 and the second microstrip 14 decreases of the same amount.

Figure 4:
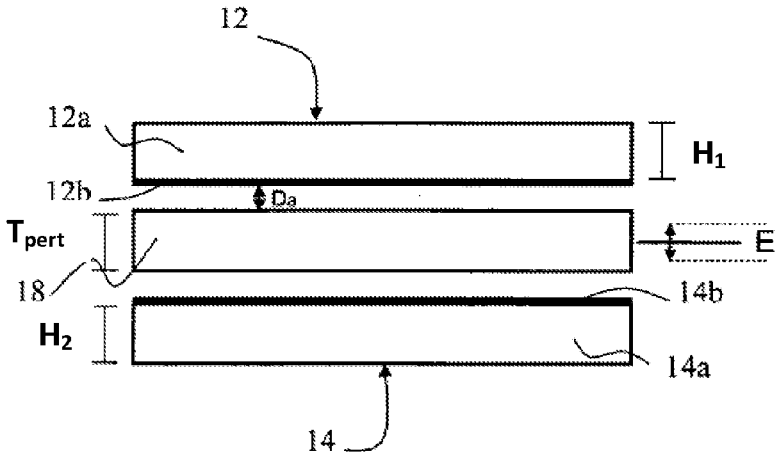
FIG. 4 details some of the features of the delay element of FIG. 3.

In FIG. 4, upper microstrip circuit 12 includes a dielectric substrate with dielectric constant $\in_{r1}$ and a thickness $H_1$. The lower microstrip circuit 14 includes a dielectric substrate with dielectric constant $\in_{r2}$ and a thickness $H_2$. The two external sides of the substrates 12*a*, 14*a* are metallized as ground planes (not shown in the drawings), while the two microstrips 12*b*, 14*b* are realized on the internal facing sides, in such a way that, when two electromagnetic signals are fed to the two microstrips, the electromagnetic field is confined into the region between the two ground planes. In particular, a relevant part of the electromagnetic field is confined in the spatial region between the two microstrips.

The perturber 18 is a slab comprised of one or more dielectric materials, metals or a combination of metals and dielectric materials. The perturber 18 is arranged in the spatial region between the two substrates, In order to perturb the electromagnetic field propagating in the spatial region of the gap. The perturber 18 has a thickness $T_{pert}$, and when dielectric materials are used in the perturber 18, these dielectric material have a high dielectric constant with respect to the dielectric constants of the two substrates ($\in_{pert} >> \in_{r1}, \in_{r2}$).

The two substrates 12*a*, 14*a* are at a fixed position Preferably, the two microstrip lines 12*b*, 14*b* are arranged parallel to each other at a distance corresponding to the thickness of perturber ($T_{pert}$) increased by a small air gap, in order to make the perturber 18 able to be displaced by the actuator 20 towards and away from the circuits 12, 14 along the axis perpendicular to the plane of circuits, as shown in FIG. 3.

The principle underlying operation of the device 10 can be explained by referring first to a simplified arrangement including a single microstrip circuit realized on a dielectric substrate (e.g. only the microstrip circuit 12 on the substrate 12*a*) and the perturber 18.

Such a system is a two-port device (IN1-OUT1) and can be described in terms of its effective dielectric constant, in the sense that the time needed for an electromagnetic signal to travel from the input port IN1 and the output port OUT1 (i.e. the delay time) is a function of the effective dielectric constant of the system. By placing a dielectric plate (i.e. the perturber 18) at a certain distance, the electromagnetic field distribution is perturbed and the system is described by a different value of the effective dielectric constant. The perturbation effect is more evident when the perturber is placed in the region close to the substrate where is localized the electromagnetic field. By moving the perturber by means of an actuator, the device becomes a tunable delay line, where the delay time can be varied by controlling the distance between the substrate and the perturber: for instance, if the distance is reduced, electromagnetic signals are slowed down and the delay time is increased; vice versa, if the distance is increased, electromagnetic signals are accelerated and the delay time is decreased.

By providing a second microstrip (i.e. the microstrip circuit 14 on the substrate 14*a*, with its input and output ports IN2 and OUT2) the arrangement becomes a tunable, differential delay line, in which the displacement of the perturber 18 arranged in the gap 16 between the two substrates 12*a*, 14*a* causes the perturber to becoming alternatively closer to and respectively farther from either microstrip circuits 12, 14. As a result, the perturber accelerates the electromagnetic signals in one microstrip circuit and, at the same time, slows down the electromagnetic signals in the other microstrip circuit, and vice versa.

By referring again to a simplified arrangement in the form a simple two-port device (having input and output ports corresponding to the extremities of a single microstrip of width $W_m$, realized on a dielectric substrate having a dielectric constant $\in_r$, and thickness $H_a$) the device can be described by an effective dielectric constant $\in_{eff}$ which is given by:

$$\varepsilon_{eff} = \frac{\varepsilon_r + 1}{2} + \frac{\varepsilon_r - 1}{2} \cdot \frac{1}{\sqrt{1 + 10 \cdot \frac{H_s}{W_m}}}$$

In the case of $$\frac{H_s}{W_m} >> 1,$$

$\in_{eff}$ tends to $$\frac{\varepsilon_r + 1}{2},$$

that is the mean (average) of the dielectric constants of the two media, i.e. the substrate and the air.

The time needed to an electromagnetic signal for travelling from the input port to output port of the microstrip is given by:

$$\tau = \frac{L}{c}\sqrt{\varepsilon_{eff}} \tag{1}$$

where L is the length of the line, c is the speed of light in free space and $\in_{eff}$ is the effective dielectric constant of the propagating medium.

If one considers now a device comprised of a microstrip realized on a substrate of dielectric constant $\in_a$, and by a dielectric slab of dielectric constant $\in_p$, placed parallel to the substrate at a distance $D_a$ (FIG. 4), a perturbation of effective dielectric constant of single microstrip $\in_{eff}$ is obtained.

In this case, the effective dielectric constant cannot be expressed by an analytical formula, but can be calculated by numerical methods (see, for instance, the article by Tae-Yeoul Yun and Kai Chang, "A Low-loss Time-Delay Phase Shifter Controlled by Piezoelectric Transducer to Perturb Microstrip Line", IEEE MICROWAVE AND GUIDED WAVE LETTERS, VOL. 10, NO. 3, MARCH 2000, pages 96-98, already cited in the introductory part of this description).

In particular, the effective dielectric constant depends on dielectric constants of materials and geometry of the constituent elements.

In such a two-port device, if one considers a perturber subsequently placed at two distances $d_1$ and $d_2$ from the substrate, with these distances corresponding to effective dielectric constants $\in_{eff1}$ and $\in_{eff2}$, respectively, the time difference for a electromagnetic signal to pass from the input port to output port of a microstrip having a length $L_m$ in the two positions of the perturber, is expressed—based on the formula (I) above, as:

$$\Delta\tau = \frac{L_m}{c}\left(\sqrt{\varepsilon_{eff2}} - \sqrt{\varepsilon_{eff1}}\right)$$

How the geometry of the device affects the effective dielectric constant $\in_{eff}$ and the time delay $\Delta\tau$ can be understood by considering two limit configurations.

If the distance $D_a$ tends to infinity—i.e. the geometry is the same of the simple microstrip previously introduced—$\in_{eff}$ will approach the mean of the dielectric constants of the substrate and of air.

If, conversely, the distance $D_a$ tends to zero, $\in_{eff}$ will essentially approach the value of the mean of the dielectric constants of the substrate and the perturber.

Because in general, the dielectric constant $\in_p>1$, by reducing progressively $D_a$, the perturbation effect will be enhanced, and the effective dielectric constant will increase monotonically. Moreover, the higher $\in_p$, the higher the perturbation effect.

The arrangement portrayed in FIGS. 1 to 4 is a four port differential tunable delay line: 'differential' because the key parameter $\Delta\tau_{diff}=\tau_1-\tau_2$ is the difference between the time $\tau_1$ needed for an electromagnetic signal to travel from the input port IN1 to the output port OUT1 of the microstrip 12 and the time $\tau_2$ needed for an electromagnetic signal to travel from the input port IN2 to the output port OUT2 of the microstrip 14; "tunable" because the value of $\Delta\tau_{diff}$ can be tuned by changing the position of the perturber 18.

In general, in the arrangement portrayed in FIGS. 1 to 4, the electromagnetic field associated to the electromagnetic signal traveling in the "upper" microstrip 12 is coupled to the electromagnetic field associated to the electromagnetic signal traveling in the "lower" microstrip 14. It is thus possible to describe the whole system by means of an effective dielectric constant $\in_{eff}$, which, again, cannot be expressed analytically, but can be calculated by numerical methods.

In the case of a perturber having a high dielectric constant, or in the case the perturber contains a metallic layer, the system can be analyzed with good approximation as comprised of two independent parts: a first part comprising the "upper" substrate 12*a*, the related microstrip 12*b* and the perturber 18, and is described by an effective dielectric constant $\in_{eff}$; and a second part comprising the "lower" substrate 14*a*, the related microstrip 14*b* and the perturber 18, and is described by an effective dielectric constant $\in_{eff2}$.

Each of these parts can be analyzed as explained in the foregoing.

In the delay element 10, the delay between the ports OUT1 and OUT2 for a given position of the perturber 18 is thus given by:

$$\tau_{diff} = \frac{L}{c}\left(\sqrt{\varepsilon_{eff1}} - \sqrt{\varepsilon_{eff2}}\right)$$

Since the position of the perturber 18 affects the $\in_{eff}$ of both microstrips, then ATM can be tuned by changing the position of the perturber.

If one again considers the perturber 18 at two different positions 1 and 2, then the difference in terms of differential time delay between the output ports OUT1 and OUT2 is given by:

$$\begin{aligned}\Delta\tau_{diff} &= \tau_{diff1} - \tau_{diff2}\\ &= \frac{L}{c}\left[\left(\sqrt{\varepsilon_{eff1}} - \sqrt{\varepsilon_{eff2}}\right)_1 - \left(\sqrt{\varepsilon_{eff1}} - \sqrt{\varepsilon_{eff2}}\right)_2\right]\\ &= \frac{L}{c}\left\{\left[\left(\sqrt{\varepsilon_{eff1}}\right)_1 - \left(\sqrt{\varepsilon_{eff1}}\right)_2\right] + \left[\left(\sqrt{\varepsilon_{eff2}}\right)_2 - \left(\sqrt{\varepsilon_{eff2}}\right)_1\right]\right\}\end{aligned}$$

The device 10 is a four-port device; in general a four-port device is described in term of scattering parameters $\vec{S}_{ij}$, where the indica i,j=1, 2, 3, 4 label the port number (IN1=1; OUT1=2; IN2=3; OUT2=4).

In the case of the arrangement described herein, the main scattering parameters are listed below and represent respectively:

$|\vec{S}_{11}|$: the return loss at port 1, i.e. the fraction of signal which is reflected at input port 1 (IN1);

$|\vec{S}_{33}|$: return loss at port 3, i.e. the fraction of signal which is reflected at input port 3 (IN2);

$|\vec{S}_{21}|$: fraction of input signal which exits from output port, when the electromagnetic signal travels from input port 1 (IN1) through output port 2 (OUT1)

$|\vec{S}_{43}|$: fraction of input signal which exits from output port, when the electromagnetic signal travels from input port 3 (IN2) through output port 4 (OUT2).

The parameters in question take into account the amount of signal which is lost due to mismatch, irradiation and dissipation in metals and dielectrics and have to be minimized.

$\mathrm{Arg}(\vec{S}_{21})$: phase of $\vec{S}_{21}$, represents the phase variation of the electromagnetic signal traveling from input port 1 (IN1) through output port 2 (OUT1).

$\mathrm{Arg}(\vec{S}_{43})$: phase of $\vec{S}_{43}$, represents the phase variation of the electromagnetic signal traveling from input port 3 (IN2) through output port 4 (OUT2).

These two parameters give quantitative information on the time needed for the signals traveling from the input ports to the output ports, i.e. from port 1 (IN1) to port 2 (OUT1) and from port 3 (IN2) to port 4 (OUT2) respectively, according to the following formula, relating time $\tau$, phase variation $\Delta\Phi$ and frequency f of an electromagnetic signal:

$$\tau = \frac{\Delta\Phi}{2\pi f}$$

As a consequence, in the device 10, the differential time delay between the ports OUT1 and OUT2 in a certain position of the perturber 18 is given by $$\tau_{diff} = \frac{L}{c}\left(\sqrt{\varepsilon_{eff1}} - \sqrt{\varepsilon_{eff2}}\right) = \frac{1}{2\pi f}\left(\mathrm{Arg}(\vec{S}_{21}) - \mathrm{Arg}(\vec{S}_{43})\right)$$

Then, considering the perturber at two different positions 1 and 2, the difference of differential time delay between ports OUT1 and OUT2 is given by:

$$\begin{aligned}\Delta\tau_{diff} &= \tau_{diff1} - \tau_{diff2}\\ &= \frac{1}{2\pi f}\left[\left(\mathrm{Arg}(\vec{S}_{21}) - \mathrm{Arg}(\vec{S}_{43})\right)_1 - \left(\mathrm{Arg}(\vec{S}_{21}) - \mathrm{Arg}(\vec{S}_{43})\right)_2\right].\end{aligned}$$

Two other scattering parameters considered are listed below:

$|\vec{S}_{41}|$: fraction of input signal which exits from output port 4 (OUT2), when the electromagnetic signal travels from the input port 1 (IN1) through the output port 2 (OUT1);

$|\vec{S}_{23}|$: fraction of input signal which exits from output port 2 (OUT1), when the electromagnetic signal travels from the input port 3 (IN2) through the output port 4 (OUT2).

$\vec{S}_{41}$ and $\vec{S}_{23}$ are coupling parameters, i.e. represent the unavoidable interaction between the two microstrips and are preferably to be minimized.

A noteworthy feature of the device 10 described herein is that it is a symmetric device; this means that the input and output ports can be exchanged so that e.g. the signal can fed into the port named OUT1 (OUT2) and exit the port IN1 (IN2), while maintaining all the device functionalities and performance features. In mathematical terms, this means that:

$$\vec{S}_{11}=\vec{S}_{22},\ \vec{S}_{33}=\vec{S}_{44}$$

$$\vec{S}_{12}=\vec{S}_{21},\ \vec{S}_{34}=\vec{S}_{43}$$

The symmetry of the device implies that $\vec{S}_{11}(d)=\vec{S}_{33}(-d)$, $\vec{S}_{21}(d)=\vec{S}_{43}(-d)$ and $\vec{S}_{41}(d)=\vec{S}_{23}(-d)$, so that only $\vec{S}_{11}$, $\vec{S}_{21}$ and $\vec{S}_{41}$ may be taken into account.

FIG. 4 details, by way of example only (and thus with no intended limiting effect of the scope of the invention) an embodiment of the arrangement described herein which was found to be particularly effective and is thus preferred at present.

In this preferred embodiment, all of the microstrip circuits 12, 14 and the perturber 18 are in the form of plates having a length L=4 cm.

Both dielectric substrates 12*a*, 14*a* are constituted by a polytetrafluoroethylene (PTFE) composite, such as Rogers RT DUROID 3006—with a (relative) dielectric constant of 6.15, a thickness H of 1.9 mm and a surface of 40×40 $mm^2$. The two microstrip circuits 12, 14 are placed parallel at a distance of 2.4 mm—measured between their internal faces carrying the strips 12*b*, 14*b*, and a $CaTiO_3$ perturber 18 (with a dielectric constant of 160) having a thickness T of 2 mm is arranged between the microstrip circuits 12, 14. In this way, the total air gap between the perturber 18 and the two microstrip circuits 12, 14 is equal to 0.4 mm. The maximum excursion E of the perturber 18 is equal to 0.25 mm, i.e. the perturber 18 moves in the range (−0.125 mm and +0.125 mm) symmetrically with respect to the mean point between the two microstrip circuits 12, 14 taken as a zero reference. In this way, the minimum distance between the microstrip circuits 12, 14 and the perturber 18 is 0.075 mm. The excursion of the perturber 18 is thus preferably in the submillimeter range, in general lower than 2 mm. The minimum substrate-perturber distance is preferably higher than 0.05 mm: this safely avoids any risk of undesired mechanical contact between the perturber 18 and the microstrip circuits 12, 14.

More generally, the actuator 20 is typically configured for displacing the perturber 18 over a maximum excursion lower than 2 mm, and preferably over a maximum excursion lower than 1 mm, a particularly preferred value being an excursion of approximately 0.25 mm.

Typically, the minimum distance between the perturber element and any of the first 12 and second 14 microstrip circuits is greater than 0.05 mm.

The metallic microstrips 12*b*, 14*b* have a width of 2.4 mm, in such a way that the impedance of each microstrip is 50 Ohm when the perturber is in the zero position, and varies in the range (45 Ohm+53 Ohm) over the whole excursion of the perturber 18.

In the exemplary embodiment illustrated in FIG. 4, the frequency of the signal used to produce the displacement of the perturber 18 is typically lower that 200 Hz, while the mass of the perturber 18 is lower than 200 g.

If performance of the exemplary device discussed herein in the frequency range 2.0 to 2.3 GHz (frequency of the RF signals delayed) is considered, $|\vec{S}_{11}|$ is lower than—15 dB over the whole frequency range, which indicates a very good matching of the input ports in all the positions of the perturber.

Also, again over the whole frequency range, $|\vec{S}_{21}|$ is higher than −0.5 dB, i.e. the delay element losses are lower than 0.25 dB in each perturber position.

Additionally, $|\vec{S}_{41}|$ is lower than −15 dB over the whole frequency range, which provides good evidence that the two electromagnetic signals are satisfactorily decoupled.

Figure 5:
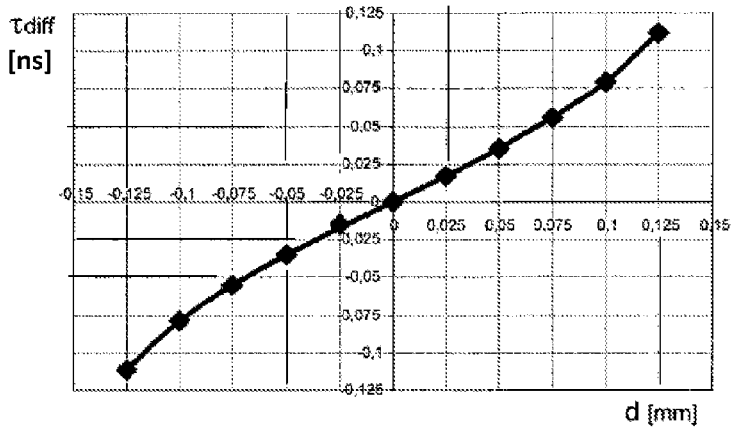
FIGS. 5 and 6 are diagrams representative of the operational characteristics of the delay element of FIGS. 3 and 4.

FIG. 5 shows the differential time delay $\tau_{diff}$ (ordinate scale, in ns.) versus the perturber displacement d (abscissa scale, in mm.) at the frequency of 2.2 GHz. The differential time delay $\tau_{diff}$ varies in the range (−0.11+0.11)ns, which means that the device 10 introduces a maximum differential time delay of 0.22 ns between the output ports with an excursion of 0.25 mm.

FIG. 5 highlights the quasi-linear relationship of the differential time delay $\tau_{diff}$ to the of perturber displacement d. This is another noteworthy feature, particularly when the device operates in a continuous way, that is the perturber 18 is moved by the linear actuator 20 up and down at a certain frequency, typically in the range of many tens of Hz (e.g. up to 200 Hz).

In the case of a linear relationship $\tau_{diff}(d)=kd$, where k is a constant value, for realizing a certain function differential time delay in function of time t, $\tau_{diff}(t)$, one simply has:

$$\tau_{diff}(t)=kd(t).$$

Figure 6:
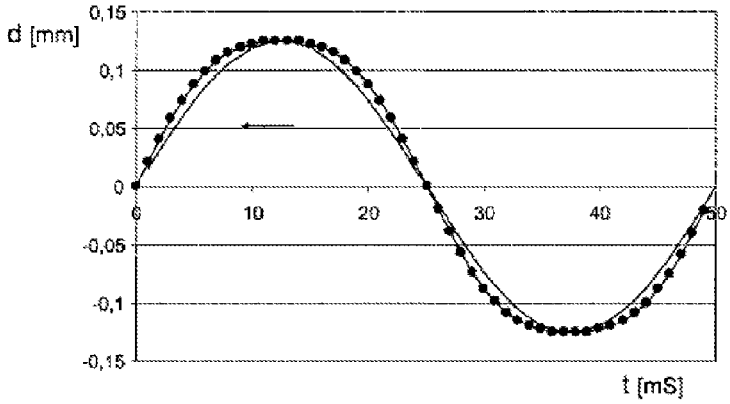

FIG. 6 exemplifies an excursion d(t) of the perturber 18, measured in mm and corresponding to the y-axis of FIG. 6, required to obtain a sinusoidal function $\tau_{diff}(t)$, with a period of T=50 ms, where the x-axis of FIG. 6 corresponds to time t measured in ms, reported for comparison in the same graph. The two curves (continuous line=purely linear relationship; dotted line=quasi-linear relationship as obtained with the device 10 described herein) are only slightly different due to the small non linearity of the relationship obtained with the device 10 described herein. As a consequence, if one considers the frequency spectrum of function d(t) that represents the movement of the perturber 18, only those frequency components very close to $$\nu = \frac{1}{T} = 20\ \text{Hz}$$

are significant.

Power handling capability is another interesting feature of the device described herein: in fact, the RF power is mainly concentrated in the region of the two microstrips 12 and 14, which are simple passive components, and the power handling capability is limited only by temperature rise due to losses in microstrip and substrate material. As indicated the device described herein exhibits very low losses and this ensures that the device is able to manage RF power levels in excess of several tens of Watts.

A preferred use of the arrangement described herein is in those telecommunication applications that require to effectively change and control time delays and phase shifts in electromagnetic signals in radiofrequency and microwave region.

Figure 7:
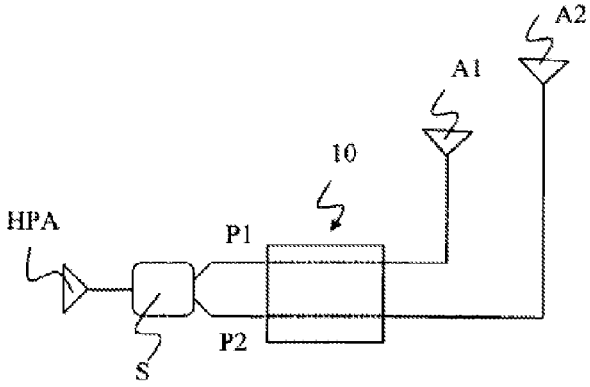
FIG. 7 is exemplary of telecommunication apparatus including a delay element as described herein.

FIG. 7 is representative of the possible use of the element 10 described herein in the area of telecommunications. More specifically, FIG. 7 refers to a telecommunication apparatus operating according to a dynamic delay diversity (DOD) technique, as described in PCT/EP2004/011204. There, RF signal power is split into two pads P1 and P2 to be then fed to first and second antennas A1 and A2, respectively, for transmission. Specifically, PCT/EP2004/011204 discloses the possibility of applying a time-variant delay to the signal transmitted by the second antenna. Thanks to this time-variant delay, the combined signal (P1+P2) eventually received by a mobile handset of an end-user presents a higher level of time-diversity so that channel decoding performed by the baseband circuits of the mobile handset provide better performance with respect to the case of a conventional single antenna transmission.

As shown in FIG. 7, when using the delay element 10 of FIG. 1 described herein, RF power from a High Power Amplifier (HPA) is fed to a splitter S to produce two signal parts P1 and P2 These are then passed through the two delay paths IN1, OUT1 and IN2, OUT2 of the delay element 10 to be then fed to first and second antennas A1 and A2, respectively, for transmission.

The two signal parts P1 and P2 are thus affected by different delays, in that the time delays of the signals is varied in both RF branches in a synchronous way: the signal P1 is "accelerated" in the upper branch and at the same time the signal P2 is "slowed down" in the lower branch, and vice-versa. A time-variant (differential) delay is thus created and the combined signal presents the desired increased level of time-diversity to improve reception performance at e.g. a mobile handset.

As indicated, the delay element 10 is able to handle high power, including very high power RF signals, and can thus be cascaded to a high power amplifier HPA and a power splitter, thus avoiding e.g. the use of two expensive high power amplifiers.

Of course, without prejudice to the underlying principles of the invention, the details and embodiments may vary, even significantly, with respect to what has been described by way of example only, without departing from the scope of the invention as defined by the annexed claims.

The invention claimed is:

1. A delay element comprising:

a first microstrip circuit comprising a first delayed travel path for a first signal from a first input port to a first output port, and a second microstrip circuit comprising a second delayed travel path for a second signal from a second input port to a second output port, said first and second microstrip circuits being arranged side-by-side in a facing relationship; and a perturber arranged between said first and second microstrip circuits, said perturber being displaceable toward and away from said first and second microstrip circuits along an axis perpendicular to said first and second microstrip circuits, whereby, when the distance of said perturber to one of said first and second microstrip circuits increases, the distance of said perturber to the other of said first and second microstrip circuits decreases and vice versa, the position of said perturber between said first and second microstrip circuits defining the difference between the time experienced by said first signal in travelling said first delayed travel path and the time experienced by said second signal in travelling said second delayed travel path.

2. A telecommunication apparatus for transmitting first and second signals via corresponding diversity antennas, comprising a delay element according to claim 1, wherein said first and second signals pass through respectively said first and second delayed travel paths of said delay element.

3. The delay element of claim 1, wherein said first and second microstrip circuits are arranged parallel to each other.

4. The delay element of claim 3, wherein said perturber has opposite planar surfaces facing and arranged parallel to said first and second microstrip circuits.

5. The delay element of claim 1, wherein said first and second microstrip circuits comprise a respective dielectric substrate having a corresponding metallic microstrip provided thereon.

6. The delay element of claim 5, wherein said respective metallic microstrips are arranged facing each other with the interposition of said perturber.

7. The delay element of claim 1, comprising an actuator to move said perturber between said first and second microstrip circuits.

8. The delay element of claim 7, wherein said actuator is capable of being configured for displacing said perturber symmetrically with respect to a mean point between said first and second microstrip circuits.

9. The delay element of claim 7, wherein said actuator is capable of being configured for displacing said perturber over a maximum excursion lower than 2 mm.

10. The delay element of claim 7, wherein said actuator is capable of being configured for displacing said perturber over a maximum excursion lower than 1 mm.

11. The delay element of claim 7, wherein said actuator is capable of being configured for displacing said perturber over an excursion of approximately 0.25 mm.

12. The delay element of claim 1, wherein the minimum distance between said perturber element and any of said first and second microstrip circuits is greater than 0.05 mm.

13. The delay element of claim 1, wherein said first and second microstrip circuits comprise a respective dielectric substrate having corresponding dielectric constants $\in_{r1}$, $\in_{r2}$ and said perturber comprises a dielectric material having a perturber dielectric constant $\in_{pert}$, and wherein $\in_{pert} >> \in_{r1}$, $\in_{r2}$.

14. The delay element of claim 1, wherein said perturber comprises a metallic material.

15. A method of delaying electrical signals comprising the steps of:

defining a first delayed travel path for a first signal from a first input port to a first output port in a first microstrip circuit as well as a second delayed travel path for a second signal from a second input port to a second output port in a second microstrip circuit;

arranging said first and second microstrip circuits side-by-side in a facing relationship with a perturber arranged between said first and second microstrip circuits; and displacing said perturber toward and away from said first and second microstrip circuits along an axis perpendicular to said first and second microstrip circuits, whereby when the distance of said perturber to one of said first and second microstrip circuits increases, the distance of said perturber to the other of said first and second microstrip circuits decreases and vice versa, the position of said perturber between said first and second microstrip circuits defining the difference between the time experienced by said first signal in travelling said first delayed travel path and the time experienced by said second signal in travelling said second delayed travel path.

* * * * *